US007270734B1

(12) United States Patent
Schetty, III et al.

(10) Patent No.: US 7,270,734 B1
(45) Date of Patent: Sep. 18, 2007

(54) NEAR NEUTRAL PH CLEANING/ACTIVATION PROCESS TO REDUCE SURFACE OXIDES ON METAL SURFACES PRIOR TO ELECTROPLATING

(75) Inventors: Robert A. Schetty, III, Laurel Hollow, NY (US); Kilbnam Hwang, Cranston, RI (US)

(73) Assignee: Technic, Inc., Plainview, NY (US)

( * ) Notice: Subject to any disclaimer, the term of this patent is extended or adjusted under 35 U.S.C. 154(b) by 20 days.

(21) Appl. No.: 10/861,756

(22) Filed: Jun. 4, 2004

Related U.S. Application Data

(60) Provisional application No. 60/476,461, filed on Jun. 6, 2003.

(51) Int. Cl.
*C25D 5/50* (2006.01)
*C25D 5/02* (2006.01)
*C25D 5/34* (2006.01)

(52) U.S. Cl. ..... 205/224; 205/118; 205/123; 205/125; 205/210; 205/215; 205/219

(58) Field of Classification Search ..... 205/118, 205/123, 125, 210, 215, 219, 224
See application file for complete search history.

(56) References Cited

U.S. PATENT DOCUMENTS

| | | | | |
|---|---|---|---|---|
| 5,104,494 | A * | 4/1992 | Tench et al. | 205/125 |
| 6,319,728 | B1 * | 11/2001 | Bhan et al. | 438/687 |
| 2002/0074242 | A1 * | 6/2002 | Morrissey et al. | 205/704 |

FOREIGN PATENT DOCUMENTS

JP 56116726 A * 9/1981

* cited by examiner

*Primary Examiner*—Edna Wong
(74) *Attorney, Agent, or Firm*—Winston & Strawn LLP

(57) ABSTRACT

The invention relates to a method for electroplating a metal deposit on electroplatable portions of composite articles that have both electroplatable and non-electroplatable portions. In this method, the invention is an improvement which comprises treating the articles prior to electroplating to provide the electroplatable portions with enhanced electroplatability. This is achieved by passing a current though a near neutral pH solution that contains a conductivity agent and a buffer to reduce or remove surface oxides and contaminants from such portions without deleteriously affecting the non-electroplatable portions of the articles. When the treated surfaces are subsequently subjected to metal plating, a uniform, smooth metal deposit is achieved.

16 Claims, No Drawings

NEAR NEUTRAL PH CLEANING/ACTIVATION PROCESS TO REDUCE SURFACE OXIDES ON METAL SURFACES PRIOR TO ELECTROPLATING

This application claims the benefit of provisional application 60/476,461 filed Jun. 6, 2003, the entire content of which is expressly incorporated herein by reference thereto.

FIELD OF THE INVENTION

The present invention relates to a solution and process for treating metal surfaces to reduce surface oxides prior to electroplating to facilitate and improve the electrodeposition of metals onto the treated surface.

BACKGROUND ART

In the electroplating industry it is common to electroplate metals such as copper, nickel, tin, and tin alloys onto various base metals and/or on top of previously applied plated coatings. The surface to be plated must be as clean and free of metal oxides as is practical in order to ensure a uniform, smooth, adherent deposition of plated metal during the electrodeposition process. Therefore, during processing, the substrates or parts to be plated pass through a series of cleaning and/or activation solutions prior to each electroplating operation. Normally, these cleaning and activation solutions are either strongly alkaline to achieve good detergency and therefore cleaning ability and/or strongly acidic to remove surface oxides through etching of the metal surface which "under-cuts" the oxide thereby facilitating its removal.

In certain applications, particularly in electroplating operations for electronic components, the substrate cannot be exposed to strongly alkaline or strongly acidic solutions. This is the case with, for example, semiconductor wafers which contain sensitive dielectric and metallized materials of chip construction, passive components such as multilayer chip capacitors which contain pH sensitive materials of construction, or printed circuit board (PCB) applications with acid- or alkaline-sensitive materials of construction. In such applications, the traditional alkaline or acidic cleaning and activation solutions cannot be implemented without detrimentally affecting the components. It has been necessary in such applications to eliminate or minimize oxide formation on surfaces to be electroplated through implementation of extremely careful handling or processing techniques, or to simply process the parts to be plated without a cleaning/activation step, thereby compromising deposit quality.

What is needed for such pH sensitive applications is an effective near neutral pH cleaning/activation solution that enhances the ability of the metal surfaces to receive metal electrodeposits thereon. This need is now met by the present invention.

SUMMARY OF THE INVENTION

The invention relates to a method for electroplating a metal deposit on electroplatable portions of composite articles that have both electroplatable and non-electroplatable portions. In this method, the invention is an improvement which comprises treating the articles prior to electroplating to provide the electroplatable portions with enhanced electroplatability by passing a current though a near neutral pH solution that contains a conductivity agent in an amount sufficient to facilitate passage of the current through the solution and a pH controlling agent in an amount sufficient to assist in maintaining pH at a near neutral range. Thus, current passing through solution reduces or removes surface oxides and contaminants from the electroplatable portions of the articles without deleteriously affecting the non-electroplatable portions of the articles.

Advantageously, the conductivity agent comprises an acid or an acidic compound, and the pH controlling agent comprises a buffer or basic compound that maintains the pH of the solution in the range of between about 7 and about 10. In one embodiment, the conductivity agent is a weak acid, the buffer comprises an alkaline compound such as a weak base, and the pH is about 7.5 to about 9. Preferably, the conductivity agent comprises boric acid and the buffer comprises an alkaline borate compound. The alkaline borate compound may be borax or an alkali metal borate.

The current that is passed through the solution is sufficient to reduce the surface oxides to a metallic state. To do this, the current is preferably applied at a voltage in the range of about 4 to about 9 volts for a period of between about 1 to about 300 seconds, and at a temperature of between about 15° C. and 60° C.

The types of oxides that are removed or reduced by this method include copper oxides, nickel oxides, tin oxides, or the like. These oxides generally occur on the electroplatable portions of the articles during processing of the articles prior to electroplating, such as during a heat treatment at a temperature sufficient to form the surface oxides. By removal of the oxides, the subsequent metal electroplating provides a uniform, smooth metal deposit.

DETAILED DESCRIPTION OF THE PREFERRED EMBODIMENTS

As noted, the invention relates to a method for enhancing the electroplatability of the electroplatable or metal portions of composite articles by minimizing or eliminating metal oxides on the surface of such portions. This is done by immersing the articles in a near neutral pH solution and applying a cathodic current which reduces the oxides to their metallic state. The term "near neutral pH solution" is used to designate a solution having a pH range that is mildly acidic to mildly alkaline so that the solution does not attack sensitive materials of construction such as the plastic or ceramic portions of composite substrates such as semiconductor wafers, chip capacitors, printed circuit boards, etc. and so has wide usefulness and application in industry.

The present invention provides a method for cleaning surface oxides from the metallic portions of a composite article without deleteriously affecting the non-electroplatable portions of the articles. The method removes substantially all surface oxides and discontinuities. This method is useful for treating any metal that will subsequently be subjected to metallization, preferably electrolytic metallization. Suitable metals include but are not limited to copper, copper alloys, nickel, nickel alloys, cobalt, cobalt alloys, tin, tin alloys, gold, gold alloys, platinum, platinum alloys, iridium, iridium alloys, palladium, palladium alloys, rhodium, rhodium alloys and the like. It is preferred that the metal be copper, a copper alloy, nickel, a nickel alloy, tin or a tin alloy.

In one aspect of the present invention, metal oxide contained on the surface is reduced to the metal. The term "metal oxide contained on the surface" refers to surface layers of metal oxide on the metal. Such reduction of the metal oxide in the surface is achieved without the use of etchant solutions. Etchant solutions dissolve away the metal oxide, thus providing a metal layer having reduced thickness. For thin metal layers, such as seed layers, such dissolution of the metal oxide results in even thinner metal layers and possibly a complete dissolution of the metal layer in places, thereby creating discontinuities. Thus, the present invention provides a method of providing a surface that is substantially free of metal oxide, without dissolution of the metal oxide. By "substantially free of metal oxide" is meant a surface where the amount of metal oxide present is less than that which would interfere with the subsequent provision of an electroplated metal deposit on that surface. It is preferred that the surface be completely free of metal oxides for optimum results.

The metal oxide on the surface is reduced by contacting the surface disposed on a substrate with an aqueous solution preferably having a pH in the range of about 7 to about 10 and by subjecting the aqueous solution to a voltage of from about 4 to 9 volts. Such reducing method may also be referred to as "cathodic activation." It is preferred that the pH of the aqueous solution is maintained in the range of about 7.5 to about 9. Most preferably, the pH of the aqueous solution is maintained at or near 8.

A conductivity agent is added to the solution to help it achieve the desired conductivity as determined by voltage. These agents are typically acids or acidic compounds that are weakly acidic. The acid is present in an amount sufficient to increase solution conductivity but not so high to reduce the pH to a highly acidic range of, e.g., less than 5. The most preferred weak acid is boric acid and the following description and Examples illustrate preferred solutions of that agent.

The pH controlling agent is generally a buffer or basic compound such as a weak base. The buffer preferably comprises an alkaline compound that is present in an amount that assists in maintaining the pH in the desired range. The most preferred buffer comprises an alkaline borate compound, such as borax or an alkali metal borate, and the following description and Examples illustrate preferred solutions of that compound.

Any basic compound can be used to maintain the pH of the aqueous solution in the near neutral range so that it is suitable for use in the present invention. Suitable means include, but are not limited to, the periodic addition of a base to the aqueous solution or, preferably, the use of buffers. The pH of the aqueous solution may be monitored through the use of a pH meter. Such pH monitoring can be automated and the additional base or buffer metered into the aqueous solution as needed to maintain the pH.

Any buffer that maintains a pH in the desired range is suitable for use in the present invention. Suitable buffers include, but are not limited to: phosphates, tris(hydroxymethyl)aminomethane hydrohalide salt, carbonate and the like. It is preferred that the buffer is selected from phosphate, boric acid/borate and tris(hydroxymethyl) amino-methane hydrohalide salts. The buffers are generally prepared by known methods. The phosphate, borate and carbonate salts of the present invention may be any which are suitable for preparing buffers. Such salts typically include, but are not limited to, the alkali and alkaline earth salts, such as sodium and potassium, ammonium salts, and the like.

The most preferred aqueous treating solution includes 0.1 M sodium borax, 0.5 M boric acid, and a pH of about 8, as shown in the Examples.

A voltage in the range of about 4 to about 9 volts is applied to the aqueous solution to reduce the metal oxide on the surface. The inventors have found that the control of voltage is the easiest way to provide the correct amount of current in the solution. Also, the control of voltage appears independent of the size of the parts, such that any conventional electronic parts can be treated by the present methods. It is preferred that the voltage be in the range of 5 to 8 volts, more preferably 6 to 7 volts, and most preferably about 6.5 volts.

At higher pHs, less voltage is generally needed to drive the reaction to achieve the desired cleaning effects. While higher voltages can be used at the higher pHs without detrimentally affecting the results, the higher voltage levels are simply not necessary to achieve the desired cleaning effects.

The voltage is generally applied to the aqueous solution for a period of time sufficient to reduce substantially all of the metal oxide to the metal. In general, the voltage is applied to the aqueous solution for 1 to 300 seconds, preferably 5 to 200 and most preferably 10 to 140 seconds. The voltage may be applied to the aqueous solution by any conventional means, such as through the use of anodes, particularly insoluble anodes, and rectifiers on plating tools. It is preferred that the voltage be applied to the aqueous solution using insoluble anodes, particularly when a copper seed layer is being reduced. Such means are well known to those of ordinary skill in the art.

Typically, the cathodic activation method of the present invention is performed at a temperature in the range of 10° C. to 50° C., and preferably in the range of 20° C. to 40° C., most preferably below 35° C. It will be appreciated by those skilled in the art that temperatures outside this range may be successfully used in the present invention, although the length of time that the voltage is applied may be different at different temperatures. The skilled artisan can determine the optimum conditions by routine testing.

The aqueous solutions may optionally contain other components, such as surfactants, particularly nonionic surfactants, to improve wetting characteristics. It is preferred that when such optional components are used, they are used at low levels. It is further preferred that the aqueous solution of the present invention be free of added metals, more preferably free of transition metals, such as copper, aluminum, cobalt, nickel, tantalum, indium, titanium, and the like, and most preferably free of copper. Otherwise the metals may plate onto the parts from the solution.

Once any metal oxide on the surface has been reduced, the substrate is removed from the aqueous solution and rinsed, typically with deionized water. The surface can then be contacted with a plating bath to provide a final metal layer. Suitable plating baths include electroless and electrolytic plating baths. Such electrolytic plating baths may be acidic or alkaline. Any method of enhancing lateral growth to remove or reduce discontinuities may be used advantageously with the cathodic reduction process of the present invention. Any metal that may be deposited electrolessly or electrolytically and is compatible with the underlying seed layer may be used. It is preferred that both the surface and the final metal layer include the same metal or an alloy thereof. It is further preferred that the final metal layer is copper, and more preferably that the seed layer and final metal layer are both copper.

Furthermore, the present invention provides a method of ensuring a uniform, smooth, adherent deposition of plated metal during an electrodeposition process on metal surface(s) having metal oxide on the surface(s), which comprises including the steps of immersing the metal surface(s) in a near neutral pH electrolyte bath; subjecting the electrolyte bath to a cathodic current during a cathodic activation step which reduces the oxides to their metallic state; removing the metal surface(s) from the electrolyte bath; rinsing the metal surface(s), preferably with deionized water, and; subjecting the metal surfaces to a metal plating bath to achieve a uniform, smooth metal plating.

EXAMPLES

The following examples are intended to illustrate further various aspects of the present invention, but are not intended to limit the scope of the invention in any way.

Example 1—Test of the Effectiveness of the Present Method with Nickel Oxide

Experimental

Performance testing of the metal oxide removal method according to the present invention was carried out as follows:

During Step I, an electrolytic nickel deposit was plated for the first time on a copper alloy substrate surface by High Speed Nickel Sulfamate FFP. This is achieved in a 1 L bath containing 120 g/l Ni metal, 20 ml/l Ni Bromide, 26 g/l Boric acid, wetting agent 1.8 ml/l; and brightener 10 ml/l. The plating was achieved with a current density of 50 ASF at 40° C. for 1 min. Nickel S was used as the anode. A deposit thickness of 1 micron was achieved.

During Step II, a Nickel Oxide Layer was created. This was achieved by baking the nickel deposit in an air atmosphere oven at 260° C. for 0.5 hours.

During Step III, the nickel oxide layer was removed by applying the chemistry treatment according the present invention. 500 ml/l of an aqueous solution which includes 0.1 M sodium borax and 0.5 M boric acid was applied, while no treatment was applied to the control. The oxide removal solution had a pH of between about 7.8 to about 8. A potential of about 5 V was applied for between 10 to 60 seconds. This step was carried out at room temperature.

During Step IV, an electrolytic nickel deposit was plated for the second time on a substrate of a nickel surface from first nickel plating that included the nickel oxide layer. This is achieved by High Speed Nickel Sulfamate FFP in a 1 L bath containing 120 g/l Ni metal, 20 ml/l Ni Bromide, 26 g/l Boric acid, wetting agent 1.8 ml/l; and brightener 10 ml/l. The plating was done with a current density of 100 ASF at 40° C. for 10 min. Nickel S was again used as the anode. A deposit thickness of 20 microns of nickel was achieved.

Lastly, during Step V, the adhesion of the second nickel deposit to the first nickel deposit was checked to confirm whether nickel oxide was removed effectively during step III. During this step, an adhesive tape was first firmly applied over entire plated coupon; secondly, the adhesive tape was then removed from surface; thirdly, the adhesive tape bottom side and substrate were checked for visual observation of non-adherent Ni deposit.

Results

Effects of electrolyte buffer solution and pretreatment conditions, temperature, electrolysis time, applied voltage, oxide thickness on the adhesion of the second Ni deposit were tested and the their results are shown in the following. In all the results, symbols X, Δ, O denote poor, marginal, good performances, respectively.

1. Effect of Electrolyte Buffer Solution and Pretreatment Conditions

The surface of the substrate was pretreated at 25° C. with an electrolyte which contains borax and boric acid.

TABLE 1

Effect of electrolyte buffer solution and pretreatment conditions on the adhesion of 2nd Ni layer

| | | Pretreatment conditions | | | | |
|---|---|---|---|---|---|---|
| # | Samples | pH | Temp., ° C. | Time, Sec | Voltage V | Adhesion |
| 1 | As plated | — | — | — | — | O |
| 2 | Control | — | — | — | — | X |
| 3 | Pretreated | 9.1 | 25 | 30 | 1.5 | X |
| 4 | Pretreated | 9.1 | 25 | 30 | 2.1 | O |
| 5 | Pretreated | 9.1 | 25 | 60 | 2.1 | O |
| 6 | Pretreated | 9.1 | 25 | 10 | 5.7 | O |
| 7 | Pretreated | 8.0 | 25 | 60 | 1.5 | X |
| 8 | Pretreated | 8.0 | 25 | 40 | 2.5 | Δ |
| 9 | Pretreated | 8.0 | 25 | 30 | 3.0 | Δ |
| 10 | Pretreated | 8.0 | 25 | 10 | 4.7 | O |
| 11 | Pretreated | 8.0 | 25 | 10 | 7.4 | O |
| 12 | Pretreated | 7.6 | 25 | 20 | 4.0 | Δ |
| 13 | Pretreated | 7.6 | 25 | 10 | 5.0 | Δ |
| 14 | Pretreated | 7.6 | 25 | 10 | 6.0 | O |
| 15 | Pretreated | 7.6 | 25 | 20 | 6.0 | O |

From the above, it can be concluded that the optimum buffer condition based on 2nd Ni deposit adhesion, deposit quality, and compatibility with photoresist would be pH 8 buffer systems.

2. Effect of Pre-Treatment Temperature

The surface of the substrate was pretreated with an electrolyte 0.1M borax and 0.5 M boric acid, pH 8. The pretreatment was carried out at 5 V for 10 sec.

TABLE 2

Effect of pre-treatment temperature on the adhesion 2nd Ni layer

| | | Pretreatment conditions | | | | |
|---|---|---|---|---|---|---|
| # | Samples | pH | Temp., ° C. | Time, Sec | Voltage V | Adhesion |
| 1 | As plated | — | — | — | — | O |
| 2 | Control | — | — | — | — | X |
| 3 | Pretreated | 8.0 | 15 | 10 | 5 | O |
| 4 | Pretreated | 8.0 | 25 | 10 | 5 | O |
| 5 | Pretreated | 8.0 | 35 | 10 | 5 | O |
| 6 | Pretreated | 8.0 | 45 | 10 | 5 | O |

From the results above, no effects of the pre-treatment temperature on the adhesion of $2^{nd}$ Ni layer was detected. However, it is recommended that a temperature of below 35° C. be used.

3. Effect of Electrolysis Time

The surface of the substrate was pretreated at 5 V, 25° C. with an electrolyte 0.1M borax and 0.5 boric acid, at a pH of 8.

TABLE 3

Effect of pre-treatment time on the adhesion of 2nd Ni layer

| # | Samples | Pretreatment conditions pH | Temp., ° C. | Time, Sec | Voltage V | Adhesion |
|---|---|---|---|---|---|---|
| 1 | As plated | — | — | — | — | O |
| 2 | Control | — | — | — | — | X |
| 3 | Pretreated | 8.0 | 25 | 5 | 5 | Δ |
| 4 | Pretreated | 8.0 | 25 | 10 | 5 | O |
| 5 | Pretreated | 8.0 | 25 | 30 | 5 | O |
| 6 | Pretreated | 8.0 | 25 | 60 | 5 | O |
| 7 | Pretreated | 8.0 | 25 | 90 | 5 | O |
| 8 | Pretreated | 8.0 | 25 | 120 | 5 | O |
| 9 | Pretreated | 8.0 | 25 | 180 | 5 | Δ |

It can be concluded from the results above that the optimal electrolysis time is about 10 to 140 seconds at 5V.

4. Effect of Applied Voltage

The surface of the substrate was pretreated at 25° C. for 30 sec with an electrolyte of 0.1M borax and 0.5 M boric acid, and having a pH of 8.

TABLE 4

Effect of applied voltage on the adhesion of 2nd Ni layer

| # | Samples | Pretreatment conditions pH | Temp., ° C. | Time, Sec | Voltage V | Adhesion |
|---|---|---|---|---|---|---|
| 1 | As plated | — | — | — | — | O |
| 2 | Control | — | — | — | — | X |
| 3 | Pretreated | 8.0 | 25 | 30 | 2.0 | X |
| 4 | Pretreated | 8.0 | 25 | 30 | 3.0 | Δ |
| 5 | Pretreated | 8.0 | 25 | 30 | 4.0 | O |
| 6 | Pretreated | 8.0 | 25 | 30 | 5.0 | O |
| 7 | Pretreated | 8.0 | 25 | 30 | 6.0 | O |
| 8 | Pretreated | 8.0 | 25 | 30 | 7.0 | O |
| 9 | Pretreated | 8.0 | 25 | 30 | 8.0 | O |
| 10 | Pretreated | 8.0 | 25 | 30 | 9.0 | O |

From the above table, the optimal applied voltage range is about 4 to 9 V, and most preferably is 6.5 V.

5. Effect of Oxide Thickness

The surface of the substrate was pretreated at 5 V, 25° C. for 30 seconds with an electrolyte of 0.1M borax and 0.5 M boric acid and a pH of 8. The control conditions are: oven baking temperature and time: 150° C. for 10 min, 200° C. for 10 min, and 260° C. for 2 min, 10 min, 30 min and 90 min.

TABLE 5

Effect of oxide thickness on the adhesion of 2nd Ni layer

| # | Nickel oxidation Temp., ° C. | Time, min. | Samples | Pretreatment Voltage, V | Time, sec | Adhesion |
|---|---|---|---|---|---|---|
| 1 | 150 | 10 | Control | — | — | Δ |
| 2 | | | Pretreated | 5 | 30 | O |
| 3 | 200 | 10 | Control | — | — | X |

TABLE 5-continued

Effect of oxide thickness on the adhesion of 2nd Ni layer

| # | Nickel oxidation Temp., ° C. | Time, min. | Samples | Pretreatment Voltage, V | Time, sec | Adhesion |
|---|---|---|---|---|---|---|
| 4 | | | Pretreated | 5 | 30 | O |
| 5 | 260 | 10 | Control | — | — | X |
| 6 | | | Pretreated | 5 | 30 | O |
| 7 | 260 | 30 | Control | — | — | X |
| 8 | | | Pretreated | 5 | 30 | O |
| 9 | 260 | 90 | Control | — | — | X |
| 10 | | | Pretreated | 5 | 30 | Δ |
| 11 | 260 | 2 | Control | — | — | X |
| 12 | | | Pretreated | 5 | 30 | O |
| 13 | 260 | 2 | Control | — | — | X |
| 14 | | | Pretreated | 2.5 | 30 | Δ |

From the table above, it can be concluded that a good adhesion is maintained even when an oxidation thickness is increased under the same oven baking conditions. Also, better pre-treatment abilities can be achieved with a higher applied voltage.

Discussion

Control sample (no treatment) demonstrated very poor adhesion of second nickel deposit, indicating nickel oxide layer was not removed which resulted in poor adhesion of second plated Ni deposit. Sample treated by the method according to the present invention demonstrated excellent adhesion of second nickel deposit, indicating nickel oxide layer was completely removed which resulted in excellent adhesion of second plated Ni deposit. The present method effectively removes nickel oxide layers from a near-neutral pH solution which enables excellent adhesion of subsequent plated layers.

Example 2—Electroreduction of Copper Oxide

The experimental protocols are the same as Example 1 except that: copper oxide was prepared by oven baking at 190° C. for 5 min; the oxidized sample was cleaned at 7 V for 10 sec.

Visual appearance after electroreduction of copper oxide was good.

Example 3—Electroreduction of Tin Oxide

The experimental protocols are the same as Example 1 except that: tin oxide was prepared by oven baking at 175° C. for 30 min; the pretreatment conditions were 7 V, 10 sec at 25° C. The results are shown below:

TABLE 6

Results of electroreduction of Tin oxide

| # | Samples | Pretreatment conditions pH | Temp., ° C. | Time, Sec | Voltage V | Adhesion |
|---|---|---|---|---|---|---|
| 1 | As plated | — | — | — | — | O |
| 2 | Control | — | — | — | — | X |
| 3 | Pretreated | 8.0 | 25 | 10 | 7.0 | O |

A good ability for electroreduction of tin oxidation surface was shown. This shown that the as-plated metal has low levels of oxide but that baking, which is representative of a subsequent operation, does cause the generation of an oxide, which is removed by the present invention.

Discussion

The present method for cleaning an oxidation on tin-plated surface is able to be applied for general cleaning processes of metal oxidized surface. Optimum conditions are as follows: Electrolyte: 0.1 M borax and 0.5 M boric acid, pH of 8; Applied voltage: 4 V to 9 V; Pretreatment time: 10 sec to 140 sec. (depending upon the applied voltage); Temperature: Room temperature.

What is claimed is:

1. A method for enhancing the electroplatability of electroplated metal deposits of composite electronic component articles that have both electroplatable and non-electroplatable portions with the electroplatable portions comprising the electroplated metal deposits and the non-electroplatable portions comprising pH sensitive materials of construction, which method comprises:

electroplating the articles to provide the electroplated metal deposits thereon;

subsequently subjecting the articles to processing that include heating, treating the electroplated articles after the processing to provide the electroplatable metal deposit portions with enhanced electroplatability by passing a current though a near neutral pH solution that contains a conductivity agent in an amount sufficient to facilitate passage of the current through the solution and a pH controlling agent in an amount sufficient to assist in maintaining pH at a near neutral range of between about 7 and about 10, wherein the solution reduces surface metal oxides and contaminants from the electroplatable metal deposit portions of the articles without deleteriously affecting the non-electroplatable portions of the articles; and electroplating a further metal deposit on the treated electroplatable metal deposit portions of the composite electronic component articles.

2. The method of claim 1, wherein the pH controlling agent comprises a buffer or basic compound.

3. The method of claim 2, wherein the conductivity agent comprises an acid or an acidic compound, and the basic compound of the pH controlling agent comprises an alkaline compound that maintains the pH of the solution in the recited range of between about 7 and about 10.

4. The method of claim 3, wherein the pH is about 7.5 to about 9.

5. The method of claim 3, wherein the acid of the conductivity agent is a weak acid and the alkaline compound of the pH controlling agent is a buffer comprising a weak base.

6. The method of claim 5, wherein the weak acid of the conductivity agent comprises boric acid and the weak base of the buffer comprises an alkaline borate compound, and the current that is passed through the solution is sufficient to reduce the surface oxides to a metallic state.

7. The method of claim 6, wherein the alkaline borate compound is borax or an alkali metal borate.

8. The method of claim 6, wherein the alkaline borate compound is a 0.1M solution of sodium borax and the boric acid is present as a 0.5M solution, with the pH being approximately 8.

9. The method of claim 1, wherein the current is applied at a voltage in the range of about 4 to about 9 volts.

10. The method of claim 9, wherein the current is applied for a period of between about 1 to about 300 seconds.

11. The method of claim 1, wherein the solution has a temperature which is between about 15° C. and 60° C.

12. The method of claim 1, wherein the surface metal oxides to be reduced are copper oxides, nickel oxides, or tin oxides.

13. The method of claim 12, wherein the metal oxides on the electroplatable portions of the articles are generate during processing of the articles prior to the electroplating.

14. The method of claim 13, wherein the prior processing includes a heat treatment at a temperature sufficient to form the surface oxides.

15. The method of claim 14, wherein the composite articles are multi-layer chip capacitors containing the pH sensitive materials of construction or printed circuit boards containing acid- or alkaline-sensitive materials of construction.

16. The method of claim 15, wherein the current that passes through the solution is applied at a voltage in the range of about 6 to about 9 volts.

* * * * *

UNITED STATES PATENT AND TRADEMARK OFFICE

CERTIFICATE OF CORRECTION

PATENT NO. : 7,270,734 B1
APPLICATION NO. : 10/861756
DATED : September 18, 2007
INVENTOR(S) : Schetty, III et al.

It is certified that error appears in the above-identified patent and that said Letters Patent is hereby corrected as shown below:

Title Page:
Item (75) Inventors, before "Hwang", change "Kilbnam" to -- Kilnam --.
Item (57) Abstract, line 7, after "This is achieved by passing a current", change "though" to -- through --.

Column 9:
Line 26 (claim 1, line 14), after "enhanced electroplatable by passing a current", change "though" to -- through --.

Column 10:
Line 30 (claim 13, line 2), after "the electroplatable portions of the articles are", change "generate" to -- generated --.

Signed and Sealed this

Twenty-seventh Day of November, 2007

JON W. DUDAS
*Director of the United States Patent and Trademark Office*